US006777889B2

(12) United States Patent
Solinas et al.

(10) Patent No.: US 6,777,889 B2
(45) Date of Patent: Aug. 17, 2004

(54) LIGHT ANIMATION DEVICE

(75) Inventors: Victor Solinas, Nogent sur Seine (FR); Didier Maroilley, St. Parres aux Tertres (FR)

(73) Assignee: Festilight Sarl, Troyes (FR)

( * ) Notice: Subject to any disclaimer, the term of this patent is extended or adjusted under 35 U.S.C. 154(b) by 0 days.

(21) Appl. No.: 10/257,057

(22) PCT Filed: Apr. 6, 2001

(86) PCT No.: PCT/FR01/01051

§ 371 (c)(1),
(2), (4) Date: Feb. 20, 2003

(87) PCT Pub. No.: WO01/77576

PCT Pub. Date: Oct. 18, 2001

(65) Prior Publication Data

US 2003/0168993 A1 Sep. 11, 2003

(30) Foreign Application Priority Data

Apr. 11, 2000 (FR) ..... 00 04640

(51) Int. Cl.[7] ..... H05B 37/00
(52) U.S. Cl. ..... 315/185 R; 315/192
(58) Field of Search ..... 315/185 R, 185 S, 315/192, 193; 362/806

(56) References Cited

U.S. PATENT DOCUMENTS

| | | | |
|---|---|---|---|
| 4,675,575 | A | 6/1987 | Smith et al. |
| 4,761,720 | A | 8/1988 | Solow |
| 5,726,535 | A | 3/1998 | Yan |
| 5,834,901 | A | 11/1998 | Shen |
| 5,854,541 | A | 12/1998 | Chou |
| 5,945,789 | A | 8/1999 | Chou |

FOREIGN PATENT DOCUMENTS

| | | | |
|---|---|---|---|
| CN | 2 123 677 | | 6/1992 |
| CN | 2 184 305 | | 2/1994 |
| DE | 33 38 924 | A | 5/1985 |
| EP | 0 760 448 | A | 3/1997 |
| EP | 0 805 304 | A | 11/1997 |
| WO | WO 00 13469 | A | 3/2000 |

*Primary Examiner*—David Vu
(74) *Attorney, Agent, or Firm*—Miles & Stockbridge P.C.; Edward J. Kondracki

(57) ABSTRACT

The present invention concerns a light animation device comprising an animator and a light string A first bridge and a second bridge are connected in parallel between the common feed wire and the neutral wire. A forward and a reverse diode and a series of bulbs are connected in series to the first and second bridge respectively. A reverse diode and a series of bulbs are connected in series to the second bridge. The animator has at least one pair of power supply outputs and one neutral output. A forward diode is connected in series with a live wire to at least one first power supply output of the animator, and a reverse diode is connected in series with a live wire to at least one second power supply output. The two live wires may form a common feed wire of the light string.

20 Claims, 2 Drawing Sheets

LIGHT ANIMATION DEVICE

BACKGROUND OF THE INVENTION

1. Field of the Invention

The present invention concerns a light animation device for creating visual lighting effects. The light animation device comprises at least one light string powered by an animator that generates alternating current in several power supply lines.

2. Description of the Related Art

Light strings for creating visual effects are known in the prior art. These strings are powered by animators with several power supply lines. The animator has a neutral output and several outputs supplied with alternating current. In each of these outputs supplied with alternating current, there are one or more bridges connected in parallel connected to the neutral output. A bulb or series of bulbs can be connected to these bridges. The animator, by supplying power to an output, lights the bulb or series of bulbs connected to this output. The animator is equipped with a timing device that makes it possible, based on a defined program, to supply power or not to supply power to each of the live outputs. By adjusting the timing with which the animator supplies power to each of the outputs, the user can create different visual effects. The animator can, for example, light all of the bulbs by supplying power to all of the outputs. It can, for example, supply power alternately to one output and then another, thereby lighting one series of bulbs and then another, which creates a crawl type optical effect, giving the impression that the light is moving along the light string. The problem that the invention proposes to solve is to reduce the number of wires that supply power to the light string, which has the advantage of making it possible either to reduce the thickness of the light string, or to reduce the distance between the conductors that compose the light string, while obtaining the same lighting effect as the strings of the prior art.

SUMMARY OF THE INVENTION

According to the invention, diodes are connected to an even number of live outputs of the animator. A forward diode is connected to one type of output. A reverse diode is connected to another type of output. The two output wires to which a forward diode and a reverse diode are connected then join into a common feed wire. At least two series of bulbs are then connected in parallel between this feed wire and the neutral wire. A diode is connected in series to each series of bulb. A forward diode is connected in series to one series of bulbs. A reverse diode is connected in series to the other series of bulbs. This circuit makes it possible to retain all the display variants offered by an animator with n live output lines and a neutral phase, which previously was connected to n+1 wires in the light string, and which in the invention supplies power to a light string having a number of wires less than n+1. The invention therefore makes it possible to reduce the number of wires running through the light string relative to the number of power supply lines of the animator to which the light string is connected.

According to one characteristic of the invention, the light string can be connected in series with other light strings.

According to one characteristic of the invention, the total length of a light string is a multiple of one light string unit. The shortest length of light string is called a light string unit. By connecting light string units to the light string, it is possible to modify the length of the light string.

According to one characteristic of the invention, if all the live outputs of the animator are disposed according to the invention, the length of the light string unit can be divided in half relative to the prior art.

BRIEF DESCRIPTION OF THE DRAWINGS

The invention, with its characteristics and advantages, will emerge more clearly through the reading of the description given in reference to the attached drawings, in which.

DESCRIPTION OF THE PREFERRED EMBODIMENTS

Figure 1:
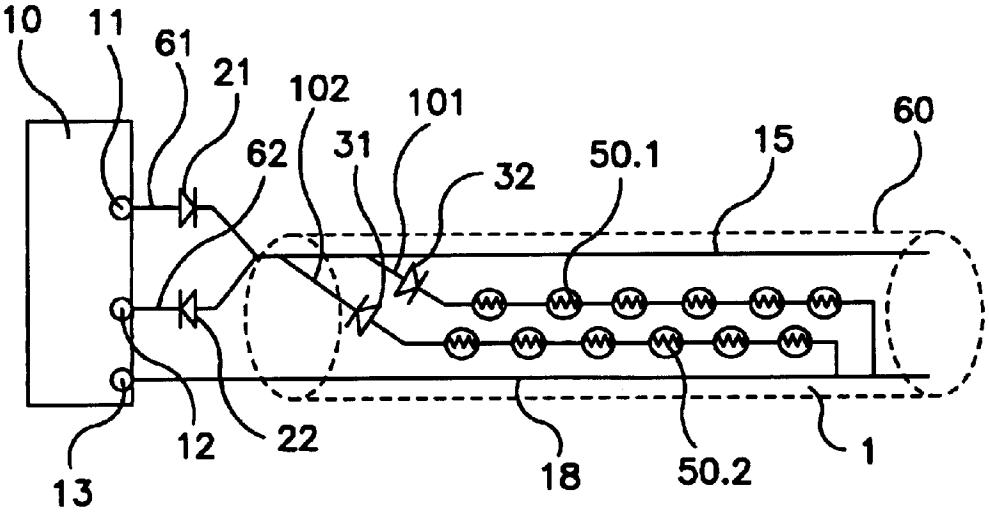
FIG. 1 represents a view of the electrical circuit according to the invention, in which appears the animator with two live outputs, which supplies power to two series of bulbs in a two-wire light string.

FIG. 1 represents the animator (10), which is specifically constituted by an alternating current generator that supplies a first power supply output (11) and a second power supply output (12) with alternating current. The animator (10) is equipped with a timing device that makes it possible to control whether or not the live outputs (11, 12) are supplied with power, based on a program selected by the user. The animator is equipped with an output (13) that is connected to the neutral wire. The first live output (11) is connected to a live wire (61) to which a forward diode (21) is connected. The second live output (12) is connected to a live wire (62) to which a reverse diode (22) is connected. The two live wires (61, 62) then join into a common feed wire (15) of the light string (1). The light string (1) specifically comprises the common feed wire (15) and a neutral wire (18). The neutral wire (18) is connected to the neutral output (13) of the animator (10). Two bridges (101, 102) are connected between the common feed wire (15) and the neutral wire (18). The first bridge (101) is constituted in series by a forward diode (31) and a series of bulbs (50.1). The second bridge (102) is constituted in series by a reverse diode (32) and a series of bulbs (50.2). The assembly of wires (18, 15, 101, 102) and bulbs (50.1, 50.2) can be embedded or extruded in a protective sheath or housing 60.

Figure 3:
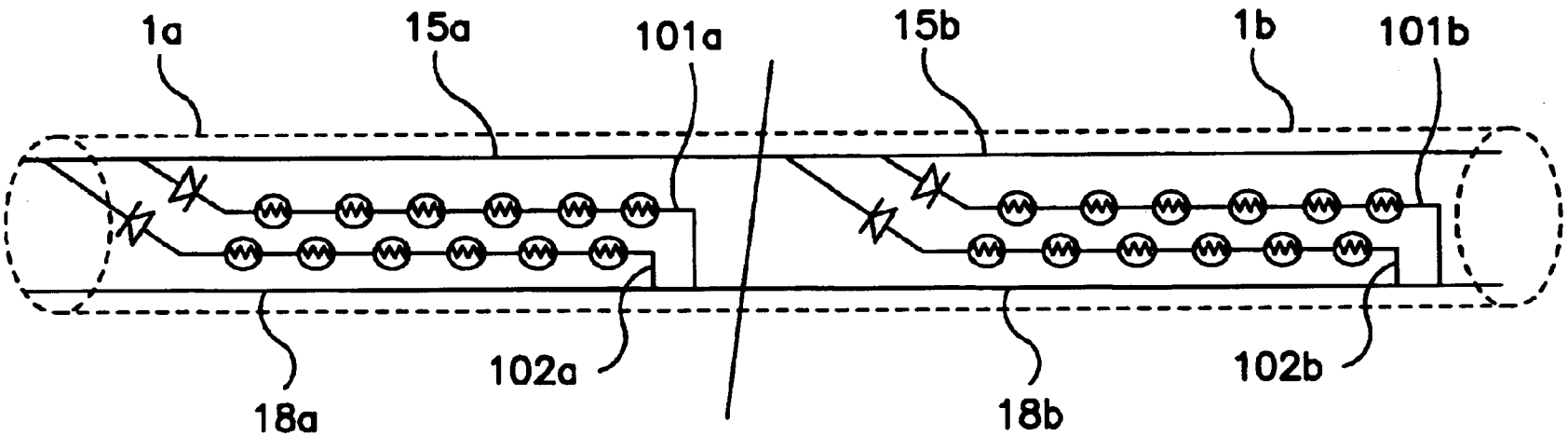
FIG. 3 represents a view of a light string composed of two light string units.

If the animator (10) supplies the first output (11) with alternating current, then only the positive alternations will pass through the diode (21) so as to reach the common feed wire (15), and the current will then flow only into the first bridge (101), since it will be blocked in the second bridge (102) by the reverse diode (32). If the animator (10) supplies the second output (12) with alternating current, then only the negative alternations will pass through the diode (22) so as to reach the common feed wire (15). The current will then flow only into the second bridge (102), since it will be blocked in the first bridge (101) by the diode (31). The invention makes it possible to supply power only to one series of bulbs (50.1) disposed on the first bridge (101) by feeding the first power supply output (11). The invention makes it possible to supply power only to another series of bulbs (50.2) disposed on the second bridge (102) by feeding the second power supply output (12). The invention thereby makes it possible to use an animator (10) with two live outputs (11, 12) and a light string (1) with two wires (18, 15), a common live wire (15) and a neutral wire (18), while retaining all the display capabilities that were offered by an animator with two live outputs and a three-wire light string of the prior art that comprised two live wires and a neutral wire. In order to be able to create crawling optical effects, inside the possible protective sheath (60) of the light string (1), the bulbs (50.1) of the first bridge (101) are disposed alternately with the bulbs (50.2) of the second bridge (102) so that, seen from afar, all of the bulbs appear to be in one line, and so that, depending on the spacing along this line, one of every two bulbs belongs to the first bridge (101) and one of every two bulbs belongs to the second bridge (102). If the user wants to increase the length of the light string (1), it is clear that the common feed wire (15) and the neutral wire (18) can be connected to a light string unit. This light string unit is constituted by the above description of the light string, which in this case is composed of only one light string unit. FIG. 3 describes a light string composed of two light string units that are connected so as to increase the length of the light string.

Figure 2:
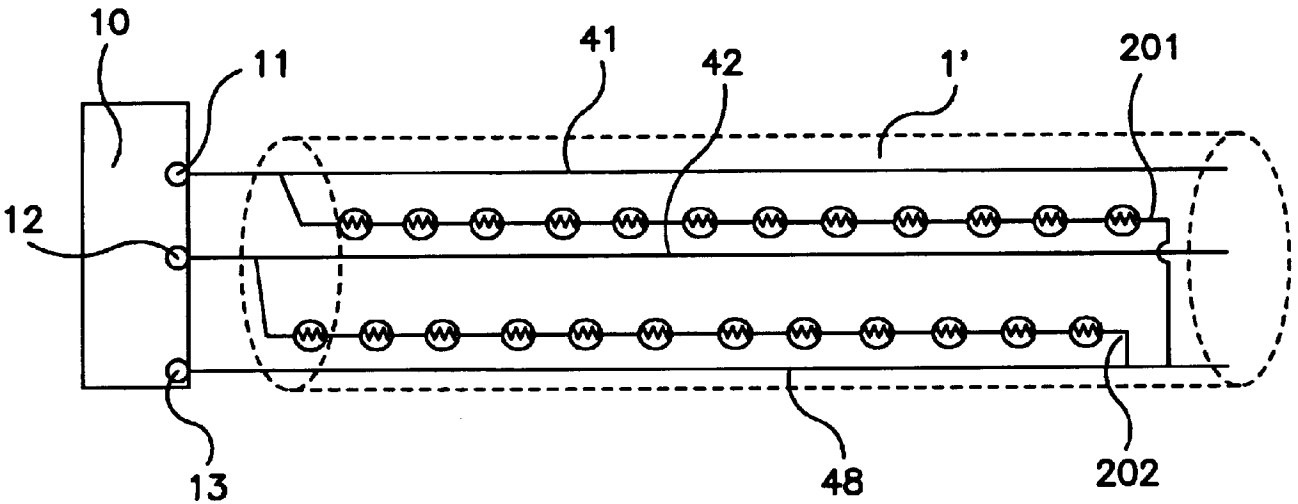
FIG. 2 PRIOR ART
FIG. 2 represents a view of the electrical circuit according to the prior art, in which appears the animator with two live outputs, which supplies power to two series of bulbs in a three-wire light string.

FIG. 2 represents an animator (10) and a light string (1') according to the prior art. The animator has three outputs (11, 12, 13). The first and second outputs (11, 12) are supplied with alternating current. The third output (13) is connected to the neutral wire. The light string (1') comprises three wires (41, 42 48). The first wire (41) is connected to the first live output (11) of the animator (10). The second wire (42) is connected to the second live output (12) of the animator (10). The third, neutral wire (48) is connected to the neutral output (13) of the animator (10). Connected between the first live wire (41) and the neutral wire (48), is a first group (201) in which a series of bulbs is mounted. Connected between the second live wire (42) and the neutral wire (48) is a second group (202) in which a series of bulbs is mounted. If the animator supplies power to the first output (11), the series of bulbs mounted in the first group (201) is lit. If the animator supplies power to the second output (12), the series of bulbs mounted in the second group (202) is lit. Traditionally, the bulbs in the first group (201) and the bulbs in the second group (202) are mounted alternately one by one in the light string (1') so as to make it possible to produce a crawl effect by supplying power alternately to the first output (11) and the second output (12). By means of a timer, the animator can thus light one series of bulbs or another, thus creating a visual effect. The light string according to the prior art, then, comprises three wires (41, 42, 48), two live wires (41, 42) and one neutral wire (48). With bulbs (50) having identical properties and disposed the same distance apart in the light strings (1, 1') according to the prior art and according to the invention, it is clear that the electrical circuit according to the invention would, for an equivalent luminosity, dispose fewer bulbs on a shorter bridge compared to the electrical circuit of the prior art. In essence, the average electrical power dissipated by the bridges (101, 102) will be less than the average electrical power dissipated by the groups (201, 202), since the diodes (31, 32) will let through only about half of the current generated by the animator (10). Under equivalent conditions, the invention therefore makes it possible to offer light strings that are smaller in size than the light strings of the prior art, while retaining the same light animation effects, which offers the advantage of being able to allow a finer adjustment of the size of a light string.

FIG. 3 represents a view of a light string with two light string units (1*a*, 1*b*) that are connected to one another by the neutral wires (18*a*, 18*b*) and the live wires (15*a*, 15*b*). The first light string unit (1*a*) comprises, as described in connection with FIG. 1, two bridges (101*a*, 102*a*) connected in parallel. The second light string unit (1*b*) comprises, as described in connection with FIG. 1, two bridges (101*b*, 102*b*) connected in parallel. To connect two light string units (1*a*, 1*b*), one need only connect the common feed wire (15*a*) of the first light string (1*a*) to the common feed wire (15*b*) of the second light string (1*b*) and connect the neutral wire (18*a*) of the first light string (1*a*) to the neutral wire (18*b*) of the second light string (1*b*). Thus, by assembling several light string units, the user can obtain a light string whose length is a multiple of the length of one light string unit. By supplying power to the first output (11), the bridges (101*a*, 101*b*) to which a forward diode is connected will be powered. By supplying power to the second output (12), the bridges (102*a*, 102*b*) to which a reverse diode is connected will be powered.

The invention, then, relates to a light animation device comprising an animator (10) and a light string (1) embedded or extruded in a protective sheath (60), characterized in that the light string (1) is connected to the animator by at least one common feed wire (15) and by a neutral wire (18). A first bridge (101) and a second bridge (102) are connected in parallel between the common feed wire (15) and the neutral wire (18). A forward diode (31) and a series of bulbs (50.1) are connected in series to the first bridge (101), and a reverse diode (32) and a series of bulbs (50.2) are connected in series to the second bridge (102).

In another embodiment, the light animation device is characterized in that the animator is equipped with at least one pair of power supply outputs (11, 12) and one neutral output (13), a forward diode (21) is connected in series with a live wire (61) to at least one first power supply output (11) of the animator and a reverse diode (22) is connected in series with a live wire (62) to at least one second power supply output (12). The two live wires (61, 62) connect with the common feed wire (15) of the light string (1) through the forward and reverse diodes (21, 22) at a location before the bridges (101, 102) join the common feed wire (15). The neutral output (13) of the animator (10) is connected to the neutral wire (18) of the light string (1).

In another embodiment, the light display device is characterized in that the threshold of the diodes (21, 22, 31, 32) is between 0.2 and 3 Volts.

In another embodiment, the light display device is characterized in that 18 bulbs are disposed on each bridge (101, 102).

In another embodiment, the display device is characterized in that in the light string (1), the bulbs connected to the first bridge (101) are disposed alternately with the bulbs connected to the second bridge (102).

In another embodiment, the display device is characterized in that a first light string (1*a*) can be connected to a second identical light string (1*b*), the common feed wire (15*a*) of the first light string is connected to the common feed wire (15*b*) of the second light string (1*b*) and the neutral wire (13*a*) of the first light string (1*a*) is connected to the neutral wire (13*b*) of the second light string (1*b*).

It should be clear to those skilled in the art that the present invention allows for embodiments in many other specific forms without going beyond the scope of application of the invention as claimed. Consequently, the present embodiments should be considered as illustrations, but can be modified within the range defined by the scope of the attached claims, and the invention should not be limited to the details given above.

What is claimed is:

1. A light animation device comprising an animator and a light string within a protective sheath, the light string being connected to the animator by at least one common feed wire and one neutral wire, a first bridge and a second bridge connected in parallel between the common feed wire and the neutral wire, a first forward diode and a series of bulbs connected in series to the first bridge, a first reverse diode and a series of bulbs connected in series to the second bridge, the animator having at least one pair of power supply outputs and one neutral output, a first and a second live wire connected respectively to a first and a second output of said one pair of power supply outputs, a second forward diode connected in series with the first live wire to the first power supply output of the animator and a second reverse diode connected in series with the second live wire to the second power supply output, the two live wires connecting with the common feed wire of the light string before the connection of the bridges to the common feed wire, and the neutral output of the animator being connected to the neutral wire of the light string.

2. A light display device according to claim 1, characterized in that the forward and reverse diodes have a threshold between 0.2 and 3 Volts.

3. A light display device according to claim 1, characterized in that at least 12 bulbs are disposed on each bridge.

4. A light display device according to claim 1, characterized in that in the light string, the bulbs connected to the first bridge are disposed alternately with the bulbs connected to the second bridge.

5. A light display device according to claim 1, characterized in that a first light string is connected to a second identical light string, each said first and second light strings having respectively a first and second common feed wire, the first common feed wire of the first light string being connected to the second common feed wire of the second light string and the first light and the second light string, each having a neutral wire connected to each other.

6. A light display device according to claim 5 wherein the first and the second common feed wires comprise a continuous wire.

7. A light display device according to claim 5 wherein the neutral wires of the first and second light string comprise a single wire.

8. A light animation device comprising an animator and a first light string and a second light string, said first and second light strings being embedded and connected in series within a protective sheath, each said first and second light string having respectively a first and second common feed wire and a first and second neutral wire, each said first common feed wire and first neutral wire being connected, respectively, to said second column feed and said second neutral wire, each said first and second light string further having a first bridge and a second bridge connected in parallel between the common feed wire and the neutral wire, a first forward diode and a series of bulbs connected in series to the first bridge, a first reverse diode and a series of bulbs connected in series to the second bridge, the animator further comprising at least one pair of power supply outputs and one neutral output, a first and a second conductive wire connected respectively to a first and a second output of said one pair of power supply outputs, a second forward diode connected in series with the first conductive wire to the first power supply output of the animator and a second reverse diode connected in series with the second conductive wire to the second power supply output, the first and second conductive wires connecting the common feed wire of the light string through the forward and reverse diodes at a location before the connection of the bridges to the common feed wire and the neutral output of the animator being connected to the neutral wires of the light string.

9. A light display device according to claim 8, characterized in that the forward and reverse diodes have a threshold between 0.2 and 3 volts.

10. A light display device according to claim 8, characterized in that at least 12 bulbs are disposed on each first and second bridge of each light string.

11. A light display device according to claim 8, characterized in that in each light string, the bulbs connected to each first bridge are disposed alternately with the bulbs connected to each second bridge.

12. A light display device according to claim 8 wherein the first and the second common feed wires comprise a continuous wire.

13. A light display device according to claim 8 wherein the neutral wires of the first and second light string comprise a single wire.

14. A light animation device comprising an animator and a first and a second light string connected in series within a protective sheath, each said light string being connected to the animator by at least a common feed wire and a neutral wire, and having a first bridge and a second bridge connected in parallel between the common feed wire and the neutral wire, a first forward diode and a series of bulbs connected in series to the first bridge, a first reverse diode and a series of bulbs connected in series to the second bridge, the animator further comprising at least one pair of power supply outputs and one neutral output, said pair of outputs being connected respectively to a first and a second conductive wire, a second forward diode connected in series with the first conductive wire connected to the first power supply output of the animator and a second reverse diode connected in series with the second conductive wire connected to the second power supply output, the first and second conductive wires connecting with the common feed wire of the light string before the connection of the bridges to the common feed wire, and the neutral output of the animator being connected to the neutral wire of the light string.

15. A light display device according to claim 14, characterized in that the forward and reverse diodes have a threshold between 0.2 and 3 Volts.

16. A light display device according to claim 14, characterized in that at least 12 bulbs are disposed on each bridge of each light string.

17. A light device according to claim 14, characterized in that each light string, the bulbs connected to the first bridge are disposed alternately with the bulbs connected to the second bridge.

18. A light display device according to claim 14, characterized in that the first light string is connected to the second light string, each said first and second light strings having respectively a first and second common feed wire, the first common feed wire of the first light string being connected to the second common feed wire of the second light string and the first light string and the second light string each having a neutral wire connected to each other.

19. A light display device according to claim 18 wherein the first and the second common feed wires comprise a continuous wire.

20. A light display device according to claim 18 wherein the neutral wires of the first and second light string comprise a continuous wire.

* * * * *

UNITED STATES PATENT AND TRADEMARK OFFICE

CERTIFICATE OF CORRECTION

PATENT NO. : 6,777,889 B2
DATED : August 17, 2004
INVENTOR(S) : Victor Solinas et al.

It is certified that error appears in the above-identified patent and that said Letters Patent is hereby corrected as shown below:

Column 5,
Line 64, after "connecting" please insert -- with --

Column 6,
Line 47, after first occurrence of "light" please insert -- display --

Signed and Sealed this

Twenty-first Day of June, 2005

JON W. DUDAS
*Director of the United States Patent and Trademark Office*